US010388444B2

(12) United States Patent
Makino et al.

(10) Patent No.: US 10,388,444 B2
(45) Date of Patent: Aug. 20, 2019

(54) ALLOY POWDER AND MAGNETIC COMPONENT

(71) Applicant: TOHOKU MAGNET INSTITUTE CO., LTD., Aoba-Ku (JP)

(72) Inventors: Akihiro Makino, Sendai (JP); Nobuyuki Nishiyama, Sendai (JP); Parmanand Sharma, Sendai (JP); Kana Takenaka, Sendai (JP)

(73) Assignee: TOHOKU MAGNET INSTITUTE CO., LTD., Sendai-shi (JP)

( * ) Notice: Subject to any disclaimer, the term of this patent is extended or adjusted under 35 U.S.C. 154(b) by 287 days.

(21) Appl. No.: 15/327,143

(22) PCT Filed: Jul. 17, 2015

(86) PCT No.: PCT/JP2015/070484
§ 371 (c)(1),
(2) Date: Jan. 18, 2017

(87) PCT Pub. No.: WO2016/010133
PCT Pub. Date: Jan. 21, 2016

(65) Prior Publication Data

US 2017/0162308 A1 Jun. 8, 2017

(30) Foreign Application Priority Data

Jul. 18, 2014 (JP) ..... 2014-147249

(51) Int. Cl.

| | |
|---|---|
| ***C22C 33/02*** | (2006.01) |
| ***C22C 38/00*** | (2006.01) |
| ***C22C 38/02*** | (2006.01) |
| ***C22C 38/10*** | (2006.01) |
| ***C22C 38/16*** | (2006.01) |
| ***C22C 45/02*** | (2006.01) |
| ***B22F 1/00*** | (2006.01) |
| ***H01F 1/147*** | (2006.01) |
| ***H01F 1/20*** | (2006.01) |
| ***H01F 1/153*** | (2006.01) |

(52) U.S. Cl.
CPC ..... *H01F 1/14766* (2013.01); *B22F 1/0003* (2013.01); *C22C 33/0278* (2013.01); *C22C 38/002* (2013.01); *C22C 38/02* (2013.01); *C22C 38/10* (2013.01); *C22C 38/16* (2013.01); *C22C 45/02* (2013.01); *H01F 1/15308* (2013.01); *H01F 1/20* (2013.01); *B22F 2301/35* (2013.01); *B22F 2999/00* (2013.01); *C22C 33/0207* (2013.01)

(58) Field of Classification Search
CPC ... C22C 33/0278; C22C 38/002; C22C 38/02; C22C 38/10; C22C 38/16; C22C 45/02; B22F 1/0003; H01F 1/14766
See application file for complete search history.

(56) References Cited

U.S. PATENT DOCUMENTS

| | | | | |
|---|---|---|---|---|
| 5,252,148 | A * | 10/1993 | Shigeta | C22C 45/02 148/305 |
| 8,287,665 | B2 * | 10/2012 | Urata | B22F 9/08 148/104 |
| 8,298,355 | B2 | 10/2012 | Yoshizawa et al. | |
| 8,491,731 | B2 | 7/2013 | Makino | |
| 9,190,195 | B2 * | 11/2015 | Kino | C22C 1/02 |
| 9,287,028 | B2 | 3/2016 | Urata et al. | |
| 9,493,866 | B2 * | 11/2016 | Otsuka | C22C 45/02 |
| 9,704,627 | B2 * | 7/2017 | Kato | H01F 1/28 |
| 9,850,562 | B2 | 12/2017 | Urata et al. | |
| 2009/0266448 | A1 | 10/2009 | Ohta et al. | |
| 2010/0040503 | A1 | 2/2010 | Yoshizawa et al. | |
| 2010/0043927 | A1 | 2/2010 | Makino | |
| 2011/0085931 | A1 | 4/2011 | Ohta et al. | |
| 2011/0108167 | A1 | 5/2011 | Ohta et al. | |
| 2012/0199254 | A1 | 8/2012 | Urata et al. | |
| 2013/0278366 | A1 | 10/2013 | Makino | |
| 2015/0159256 | A1 * | 6/2015 | Shimizu | C23C 4/06 428/836.1 |
| 2016/0177429 | A1 | 6/2016 | Urata et al. | |
| 2018/0073117 | A1 | 3/2018 | Urata et al. | |

FOREIGN PATENT DOCUMENTS

| | | | |
|---|---|---|---|
| CN | 101627140 | A | 1/2010 |
| CN | 102741437 | A | 10/2012 |
| JP | 02125801 | A | 5/1990 |
| JP | 2006241569 | A | 9/2006 |
| JP | 2007107094 | A | 4/2007 |
| JP | 2011195936 | A | 10/2011 |
| JP | 2013055182 | A | 3/2013 |
| JP | 2013067863 | A | 4/2013 |
| JP | 2015157999 | A | 9/2015 |
| TW | 201114924 | A | 5/2011 |

OTHER PUBLICATIONS

Taiwanese Office Action (and English language translation thereof) dated Sep. 21, 2018 issued in counterpart Taiwanese Application No. 104123179.
Chinese Office Action dated Dec. 27, 2017 issued in counterpart Chinese Application No. 201580038019.8.
Korean Office Action dated Dec. 11, 2017 issued in counterpart Chinese Application No. 10-2017-7001759.
Chinese Office Action (and English language translation thereof) dated Aug. 3, 2018 issued in counterpart Chinese Application No. 201580038019.8.
Extended European Search Report (EESR) dated Jul. 31, 2017 issued in counterpart European Application No. 15821921.2.
International Search Report (ISR) and Written Opinion dated Oct. 20, 2015 issued in International Application No. PCT/JP2015/070484.

(Continued)

*Primary Examiner* — Cam N. Nguyen
(74) *Attorney, Agent, or Firm* — Holtz, Holtz & Volek PC

(57) ABSTRACT

Alloy powder of a composition formula $Fe_{100-a-b-c-d-e-f}Co_aB_bSi_cP_dCu_eC_f$ having an amorphous phase as a main phase is provided. Parameters satisfy the following conditions: 3.5≤a≤4.5 at %, 6≤b≤15 at %, 2≤c≤11 at %, 3≤d≤5 at %, 0.5≤e≤1.1 at %, and 0≤f≤2 at %. With this composition, the alloy powder has good magnetic characteristics even when it has a large particle diameter such as 90 μm. Therefore, yield thereof is improved.

16 Claims, No Drawings

(56) References Cited

OTHER PUBLICATIONS

Japanese Office Action dated Oct. 14, 2015 issued in counterpart Japanese Application No. 2014-147249.
Chinese Office Action dated Mar. 5, 2019 (and English translation thereof) issued in counterpart Chinese Application No. 201580038019.8.

* cited by examiner

ALLOY POWDER AND MAGNETIC COMPONENT

TECHNICAL FIELD

This invention relates to Fe-based amorphous alloy powder which can be used in an electronic component, such as an inductor, a noise filter or a choke coil.

BACKGROUND ART

Patent Document 1 proposes alloy powder having an amorphous phase as a main phase. An average particle diameter of the alloy powder of Patent Document 1 is 0.7 μm or more and 5.0 μm or less.

PRIOR ART DOCUMENTS

Patent Document(s)

Patent Document 1: JPA2013-55182

SUMMARY OF INVENTION

Technical Problem

Considering use in an electronic component such as a noise filter or a choke coil, saturation magnetic flux density may be small in comparison with a case of use in a motor, but it is necessary to keep coercive force small and iron loss low. To meet such demands and obtain stably powder having a large particle diameter, it is requested to improve amorphous forming ability of an alloy. When powder is produced from the alloy having the high amorphous forming ability, yield of forming the powder having good characteristics can be improved.

Therefore, the present invention aims to provide alloy powder having high amorphous forming ability.

Solution to Problem

One aspect of the present invention provides alloy powder of a composition formula $Fe_{100-a-b-c-d-e-f}Co_aB_bSi_cP_dCu_eC_f$ having, as a main phase, an amorphous phase or a mixed phase structure of the amorphous phase and a crystal phase of α-Fe. Parameters satisfy following conditions: 3.5≤a≤4.5 at %, 6≤b≤15 at %, 2≤c≤11 at %, 3≤d≤5 at %, 0.5≤e≤1.1 at % and 0≤f≤2 at %. In addition, a particle diameter of the alloy powder is 90 μm or less.

Furthermore, another aspect of the present invention provides a magnetic component composed using aforementioned alloy powder.

Advantageous Effects of Invention

An FeCoBSiPCu alloy or an FeCoBSiPCuC alloy which includes Co of 3.5 at % or more and 4.5 at % or less has the high amorphous forming ability, and alloy powder having a large particle diameter is easy to be obtained therefrom. The alloy is unsuitable for nano-crystalizing because a ratio of Fe is reduced. On the other hand, the alloy has good magnetic characteristics, i.e. small coercive force and low iron loss, for an electronic component. Therefore, even when powder thereof has a large particle diameter, good magnetic characteristics are obtained, and yield is improved.

DESCRIPTION OF EMBODIMENTS

While the invention is susceptible to various modifications and alternative forms, specific embodiments thereof will hereinafter be described in detail as an example. It should be understood that the embodiments are not intended to limit the invention to the particular form disclosed, but on the contrary, the intention is to cover all modifications, equivalents and alternatives falling within the spirit and scope of the present invention as defined by the appended claims.

Alloy powder according to an embodiment of the present invention is suitable for use in an electronic component such as a noise filter and is of a composition formula $Fe_{100-a-b-c-d-e-f}Co_aB_bSi_cP_dCu_eC_f$, where, 3.5≤a≤4.5 at %, 6≤b≤15 at %, 2≤c≤11 at %, 3≤d≤5 at %, 0.5≤e≤1.1 at %, and 0≤f≤2 at %. In other words, in a case where C is not included, the composition formula is $Fe_{100-a-b-c-d-e-f}Co_aB_bSi_cP_dCu_e$. In a case where C of 0≤f≤2 at % is included, the composition formula is $Fe_{100-a-b-c-d-e-f}Co_aB_bSi_cP_dCu_eC_f$.

In the present embodiment, the element Co is an essential element to form an amorphous phase. Adding the element Co of a certain amount to an FeBSiPCu alloy or an FeBSiPCuC alloy, amorphous phase forming ability of the FeBSiPCu alloy or the FeBSiPCuC alloy is improved. Accordingly, alloy powder having a large particle diameter can stably be produced. However, when a ratio of Co is less than 3.5 at %, the amorphous phase forming ability decreases under a liquid quenching condition. As a result, a compound phase is precipitated in the alloy powder, and saturation magnetic flux density decreases. On the other hand, when the ratio of Co is more than 4.5 at %, a rise of coercive force is brought. Accordingly, the ratio of Co is desirable to be 3.5 at % or more and 4.5 at % or less. Even when the ratio of Co is increased to 3.5 at % or more to improve the amorphous phase forming ability, good magnetic characteristics can be obtained by adjusting other elements of B, Si, P and Cu as follows.

In the present embodiment, the element B is an essential element to form the amorphous phase. When a ratio of B is less than 6 at %, the amorphous phase forming ability decreases under the liquid quenching condition. As a result, the compound phase is precipitated in the alloy powder, the saturation magnetic flux density decreases, and the coercive force rises. When the ratio of B is more than 15 at %, the saturation magnetic flux decreases. Accordingly, the ratio of B is desirable to be 6 at % or more and 15 at % or less.

In the present embodiment, the element Si is an essential element to form the amorphous phase. When a ratio of Si is less than 2 at %, the amorphous phase forming ability decreases under the liquid quenching condition. As a result, the compound phase is precipitated in the alloy powder, the saturation magnetic flux density decreases, and the coercive force rises. When the ratio of Si is more than 11 at %, a rise of the coercive force is brought. Accordingly, the ratio of Si is desirable to be 2 at % or more and 11 at % or less.

In the present embodiment, the element P is an essential element to form the amorphous phase. When a ratio of P is less than 3 at %, the amorphous phase forming ability decreases under the liquid quenching condition. As a result, the compound phase is precipitated in the alloy powder, and the coercive force rises. When the ratio of P is more than 5 at %, the saturation magnetic flux density decreases. Accordingly, the ratio of P is desirable to be 3 at % or more and 5 at % or less.

In the present embodiment, the element Cu is an essential element to form the amorphous phase. When a ratio of Cu is less than 0.5 at %, the saturation magnetic flux density decreases. When the ratio of Cu is more than 1.1 at %, the amorphous phase forming ability decreases under the liquid quenching condition. As a result, the compound phase is precipitated in the alloy powder, the saturation magnetic flux density decreases, and the coercive force rises. Accordingly, the ratio of Cu is desirable to be 0.5 at % or more and 1.1 at % or less.

In the present embodiment, the element Fe is a principal element and an essential element to provides magnetism, which occupies the remaining part in the aforementioned compound formula. To improve the saturation magnetic flux density and reduce raw material expenses, it is basically preferable that a ratio of Fe is large. However, when the ratio of Fe is more than 83.5 at %, a large amount of the compound phase is precipitated and the saturation magnetic flux density remarkably decreases in many cases. Furthermore, when the ratio of Fe is more than 79 at %, the amorphous forming ability decreases, and there is tendency of increasing of the coercive force. Accordingly, it is necessary to adjust precisely the ratios of metalloid elements to prevent this. Therefore, it is desirable that the ratio of Fe is 83.5 at % or less and further preferable that the ratio of Fe is 79 at % or less.

The element C may be added to the alloy composition having the aforementioned composition formula $Fe_{100-a-b-c-d-e-f}Co_aB_bSi_cP_dCu_e$ by a certain amount to reduce a total material cost. However, when a ratio of C is more than 2 at %, the saturation magnetic flux density decreases. Accordingly, it is desirable that the ratio of C is 2 at % or less (not including zero) even when adding the element C changes the composition formula of the alloy composition into $Fe_{100-a-b-c-d-e-f}Co_aB_bSi_cP_dCu_eC_f$.

The alloy powder in the present embodiment may be produced by a water atomization method, a gas atomization method, or grinding a ribbon of an alloy composition.

Furthermore, the alloy powder produced is sieved to be divided into powder having a particle diameter of 90 μm or less and powder having a particle diameter larger than 90 μm. The alloy powder, obtained in this manner, according to the present embodiment has the particle diameter of 90 μm or less, high saturation magnetic flux density of 1.6 T or more, and low coercive force of 100 A/m or less.

Molding the alloy powder according to the present embodiment allows a magnetic core, such as a wound core, a laminated core or a dust core, to be formed. Moreover, using the magnetic core allows an electronic component, such as an inductor, a noise filter, or a choke coil, to be provided.

EXAMPLE

Hereinafter, the embodiment of the present invention will be described in more detail with reference to a plurality of examples and a plurality of comparative examples.

Examples 1 to 11 and Comparative Examples 1 to 10

At first, FeCoBSiPCu alloys which did not include C were tested. In detail, materials were weighed to obtain alloy compositions of examples 1 to 11 of the present invention and comparative examples 1 to 10 listed in a table 1, and mother alloys were produced by melting the weighed materials with high frequency induction melting treatment. Each of the mother alloys was processed with a gas atomization method, and powder was obtained. Discharge quantity of alloy molten metal was set to 15 g/sec or less in average while gas pressure was set to 10 MPa or more. The powder obtained by this manner was sieved to be divided into powder having a particle diameter of 90 μm or less and powder having a particle diameter larger than 90 μm, and the alloy powder of each of the examples 1 to 11 and the comparative examples 1 to 10 was obtained. Saturation magnetic flax density Bs of the alloy powder of each example was measured in a magnetic field of 800 kA/m using a vibrating sample magnetometer (VSM). Coercive force Hc of the alloy powder of each example was measured in a magnetic field of 23.9 kA/m (300 oersted) using a direct current BH tracer. Measurement results are shown in a table 2.

TABLE 1

| | Fe | Co | B | Si | P | Cu |
|---|---|---|---|---|---|---|
| Example 1 | 79.7 | 3.6 | 8 | 4 | 4 | 0.7 |
| Example 2 | 79.3 | 4 | 8 | 4 | 4 | 0.7 |
| Example 3 | 78.7 | 4.5 | 8 | 4 | 4 | 0.8 |
| Comparative Example 1 | 80 | 3.3 | 8 | 4 | 4 | 0.7 |
| Comparative Example 2 | 78.6 | 4.7 | 8 | 4 | 4 | 0.7 |
| Example 4 | 81.2 | 4 | 6.2 | 4 | 4 | 0.6 |
| Example 5 | 72.5 | 4 | 14.8 | 4 | 4 | 0.7 |
| Comparative Example 3 | 81.4 | 4 | 5.9 | 4 | 4 | 0.7 |
| Comparative Example 4 | 71.9 | 4 | 15.3 | 4 | 4 | 0.8 |
| Example 6 | 81.2 | 4 | 8 | 2 | 4 | 0.8 |
| Example 7 | 72.1 | 4.2 | 8 | 11 | 4 | 0.7 |
| Comparative Example 5 | 79.6 | 3.9 | 10 | 1.8 | 4 | 0.7 |
| Comparative Example 6 | 73.3 | 4.4 | 6 | 11.5 | 4 | 0.8 |
| Example 8 | 78 | 4.1 | 10 | 4 | 3.2 | 0.7 |
| Example 9 | 79.6 | 3.8 | 8 | 3 | 5 | 0.6 |
| Comparative Example 7 | 80.5 | 4 | 8 | 4 | 2.8 | 0.7 |
| Comparative Example 8 | 76.6 | 4.3 | 9 | 4.1 | 5.2 | 0.8 |
| Example 10 | 78.4 | 3.9 | 9 | 4.2 | 4 | 0.5 |
| Example 11 | 79 | 4 | 8 | 4 | 4 | 1 |
| Comparative Example 9 | 77.7 | 4 | 10 | 4 | 4 | 0.3 |
| Comparative Example 10 | 79 | 4.2 | 8 | 4 | 3.6 | 1.2 |

TABLE 2

| | 90 μm and below Powder Structure | Fe Crystallinity (%) | Saturation Magnetic flux Density (T) | Coercive Force (A/m) |
|---|---|---|---|---|
| Example 1 | Amo. + Fe | 19 | 1.72 | 84.7 |
| Example 2 | Amo. | — | 1.67 | 76.3 |
| Example 3 | Amo. | — | 1.65 | 67.9 |
| Comparative Example 1 | Amo. + Fe + Comp. | 17 | 1.52 | 109.2 |
| Comparative Example 2 | Amo. + Fe | 21 | 1.58 | 147 |
| Example 4 | Amo. + Fe | 25 | 1.73 | 99.1 |
| Example 5 | Amo. | — | 1.61 | 42.1 |
| Comparative Example 3 | Amo. + Fe + Comp. | 16 | 1.55 | 152.3 |
| Comparative Example 4 | Amo. + Fe | 3 | 1.56 | 157.2 |
| Example 6 | Amo. + Fe | 23 | 1.81 | 97.6 |
| Example 7 | Amo. | — | 1.64 | 34.7 |
| Comparative Example 5 | Amo. + Fe + Comp | 15 | 1.5 | 159.6 |
| Comparative Example 6 | Amo. + Fe | 18 | 1.56 | 143.5 |
| Example 8 | Amo. | — | 1.67 | 72.8 |
| Example 9 | Amo. + Fe | 21 | 1.77 | 79.1 |

TABLE 2-continued

| | 90 μm and below Powder Structure | Fe Crystallinity (%) | Saturation Magnetic flux Density (T) | Coercive Force (A/m) |
|---|---|---|---|---|
| Comparative Example 7 | Amo. + Fe + Comp. | 12 | 1.57 | 142.1 |
| Comparative Example 8 | Amo. | 15 | 1.5 | 96.3 |
| Example 10 | Amo. | — | 1.65 | 72.8 |
| Example 11 | Amo. + Fe | 24 | 1.71 | 79.1 |
| Comparative Example 9 | Amo. + Fe | 6 | 1.37 | 98 |
| Comparative Example 10 | Amo. + Fe + Comp. | 11 | 1.55 | 143.4 |

As understood from the table 2, the alloy powder of each of the examples 1 to 11 had an amorphous phase as a main phase or had a mixed phase structure of the amorphous phase and a crystal phase of α-Fe. In contrast, the alloy powder of each of the comparative examples 1, 3, 5, 7 and 10 included a compound phase. Moreover, the alloy powder of each of the examples 1 to 11 had small coercive force of 100 A/m or less and high saturation magnetic flux density of 1.6 T or more. In contrast, the alloy powder of each of the comparative examples 1 to 10 had the saturation magnetic flux density lower than 1.6 T or had the coercive force remarkably larger than 100 A/m. Thus, according to the invention, without nano-crystalizing by means of heat treatment, small coercive force and high saturation magnetic density can be achieved.

Examples 12 to 14 and Comparative example 11

Furthermore, FeCoBSiPCuC alloys including C were tested. In detail, the materials were weighed to obtain alloy compositions of examples 12 to 14 of the present invention and a comparative example 11 listed in a table 3, and mother alloys were produced by melting the weighed materials with the high frequency induction melting treatment. Each of the mother alloys was processed with the gas atomization method, and powder was obtained. The discharge quantity of the alloy molten metal was set to 15 g/sec or less in average while the gas pressure was set to 10 MPa or more. The powder obtained by this manner was sieved to be divided into powder having a particle diameter of 90 μm or less and powder having a particle diameter larger than 90 μm, and the alloy powder of each of the examples 12 to 14 and the comparative example 11 was obtained. The saturation magnetic flux density Bs of the alloy powder of each example was measured in the magnetic field of 800 kA/m using the vibrating sample magnetometer (VSM). The coercive force Hc of the alley powder of each example was measured in the magnetic field of 23.9 kA/m (300 oersted) using the direct current BH tracer. Measurement results are shown in a table 4.

TABLE 3

| | Fe | Co | B | Si | P | Cu | C |
|---|---|---|---|---|---|---|---|
| Example 12 | 78.4 | 4.2 | 8 | 4 | 4 | 0.8 | 0.6 |
| Example 13 | 78.1 | 4 | 8.2 | 4 | 4 | 0.7 | 1 |
| Example 14 | 76.1 | 3.9 | 9 | 4.2 | 4.1 | 0.8 | 1.9 |
| Comparative Example 11 | 76.2 | 4 | 9 | 4 | 4 | 0.7 | 2.1 |

TABLE 4

| | 90 μm and below Powder Structure | Fe Crystallinity (%) | Saturation Magnetic flux Density (T) | Coercive Force (A/m) |
|---|---|---|---|---|
| Example 12 | Amo. + Fe | 18 | 1.66 | 67.2 |
| Example 13 | Amo. + Fe | 10 | 1.63 | 62.3 |
| Example 14 | Amo. | — | 1.62 | 53.6 |
| Comparative Example 11 | Amo. + Fe | 15 | 1.49 | 57.4 |

As understood from the table 4, the alloy powder of each of the examples 12 to 14 had the amorphous phase as the main phase or had the mixed phase structure of the amorphous phase and the crystal phase of α-Fe. Moreover, the alloy powder of the examples 12 to 14 had the small coercive force of 100 A/m or less and the high saturation magnetic flux density of 1.6 T or more. In contrast, the alloy powder of the comparative example 11 had low saturation magnetic flux density.

The present invention is based on a Japanese patent application of JP2014-147249 filed before the Japan Patent Office on Jul. 18, 2014, the content of which is incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

The invention claimed is:

1. An alloy powder of a composition formula $Fe_{100-a-b-c-d-e-f}Co_aB_bSi_cP_dCu_eC_f$ having, as a main phase, an amorphous phase or a mixed phase structure of the amorphous phase and a crystal phase of α-Fe, wherein:

$72.1 \leq 100-a-b-c-d-e-f$, $3.5 \leq a \leq 4.5$ at %, $6 \leq b \leq 15$ at %, $2 \leq c \leq 11$ at %, $3 \leq d \leq 5$ at %, $0.5 \leq e \leq 1.1$ at %, $0 \leq f \leq 2$ at %, and the alloy powder has a particle diameter of 90 μm or less and an Fe crystallinity of 25% or lower.

2. The alloy powder as recited in claim 1, wherein $72.1 \leq 100-a-b-c-d-e-f \leq 83.5$ at %.

3. A magnetic component formed using the alloy powder as recited in claim 2.

4. The alloy powder as recited in claim 1, wherein $72.1 \leq 100-a-b-c-d-e-f \leq 79$ at %.

5. A magnetic component formed using the alloy powder as recited in claim 4.

6. The alloy powder as recited in claim 1, wherein the alloy powder has saturation magnetic flux density of 1.6 T or more and coercive force of 100 A/m or less.

7. A magnetic component formed using the alloy powder as recited in claim 6.

8. The alloy powder as recited in claim 1, wherein $6 \leq b < 10$ at %.

9. A magnetic component formed using the alloy powder as recited in claim 8.

10. The alloy powder as recited in claim 1, wherein $0.5 \leq e \leq 1$ at %.

11. A magnetic component formed using the alloy powder as recited in claim 10.

12. The alloy powder as recited in claim 1, wherein the Fe crystallinity is 21% or lower.

13. A magnetic component formed using the alloy powder as recited in claim 12.

14. The alloy powder as recited in claim 1, wherein:

$6 \leq b < 10$ at %, $2 < c \leq 11$ at %, $0.5 \leq e \leq 1$ at %, and the Fe crystallinity is 21% or lower.

15. A magnetic component formed using the alloy powder as recited in claim 14.

16. A magnetic component formed using the alloy powder as recited in claim 1.

* * * * *